United States Patent [19]

Macomson

[11] 4,260,574

[45] Apr. 7, 1981

[54] METHOD OF MAKING AN ORNAMENTAL REPLICA OF A HAND

[76] Inventor: James B. Macomson, 212 B W. 2nd Ave., Gastonia, N.C. 28052

[21] Appl. No.: 28,236

[22] Filed: Apr. 9, 1979

[51] Int. Cl.[3] ..... B22D 25/02

[52] U.S. Cl. ..... 264/129; 264/222; 264/226; 264/258; 428/15

[58] Field of Search ..... 264/222–227, 264/129, 258; 425/2; 428/15

[56] References Cited

U.S. PATENT DOCUMENTS

| | | | |
|---|---|---|---|
| 2,390,138 | 12/1945 | Vallandigham | 264/222 |
| 2,453,604 | 11/1948 | Tenenbaum et al. | 264/222 |
| 2,473,723 | 6/1949 | Nelson | 264/222 |
| 2,599,573 | 6/1952 | Milton et al. | 264/222 |
| 2,712,160 | 7/1955 | Sterczek | 264/222 |
| 2,810,161 | 10/1957 | Milton et al. | 264/222 |
| 3,479,691 | 11/1969 | Durland | 425/2 |
| 3,601,177 | 8/1971 | Hall | 264/222 |
| 4,015,327 | 4/1977 | McCarthy | 264/222 |
| 4,086,666 | 5/1978 | Vaskys et al. | 264/222 |

*Primary Examiner*—Jay H. Woo
*Attorney, Agent, or Firm*—W. Thad Adams, III

[57] ABSTRACT

A method for making an ornamental replica of a hand, including the steps of placing the hand to be reproduced onto a smooth surface, applying an elastic, impression-forming material over the hand and providing a support means for the impression-forming material to prevent any distortion thereof, allowing the impression-forming material time in which to form a mold over the hand and thereby create a negative impression of the hand therein, removing the hand from the impression-forming material and filling the negative impression therein with a fluid material capable of hardening to form a positive impression, and withdrawing the hardened positive impression of the hand from the elastic impression-forming material and applying an ornamental finish to the positive impression of the hand. The method provides a decorative replica of a hand, the replica having a planar bottom surface which particularly lends it to use as a paperweight, bookend or the like.

11 Claims, 12 Drawing Figures

FIG. 1
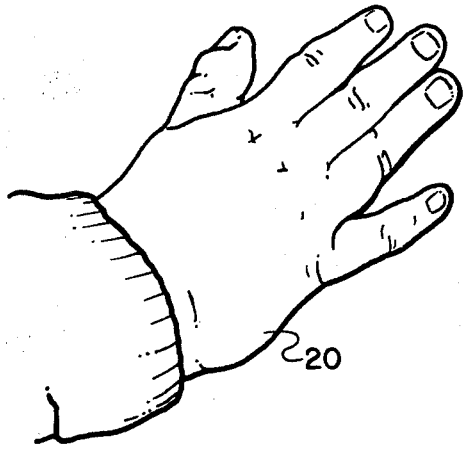
FIG. 2
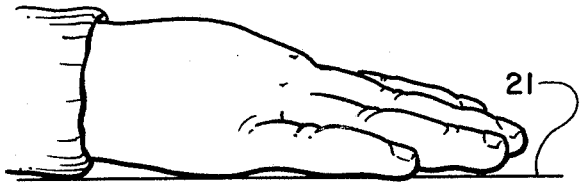
FIG. 3
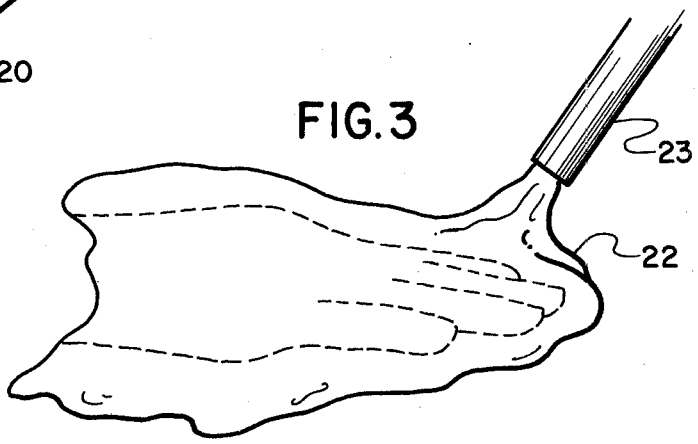
FIG. 4
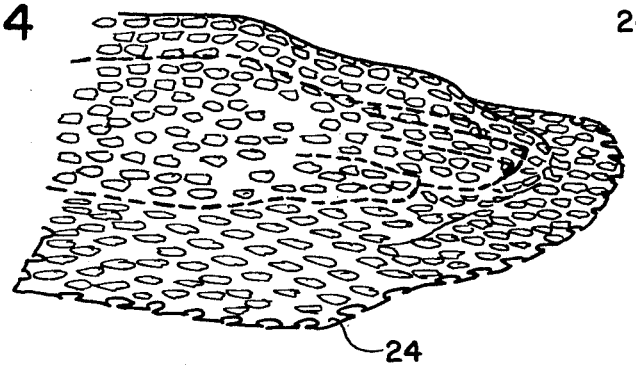
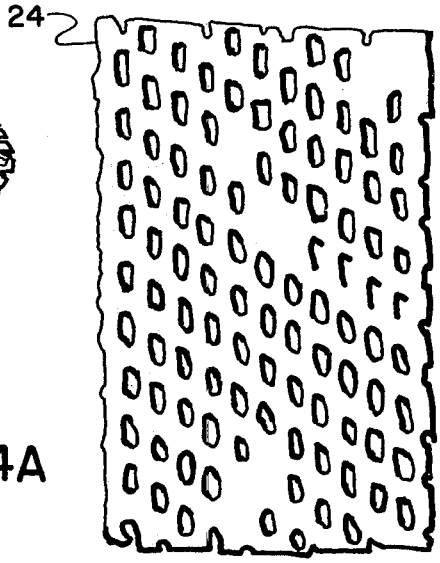
FIG. 4A
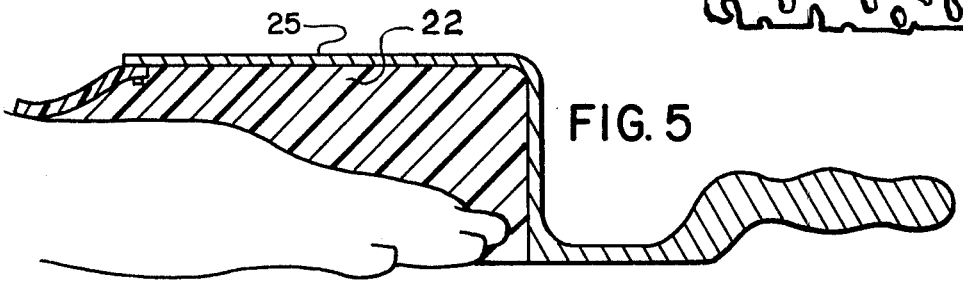
FIG. 5

METHOD OF MAKING AN ORNAMENTAL REPLICA OF A HAND

BACKGROUND OF THE INVENTION

The present invention relates to a method for making an ornamental replica of a hand, typically a child's hand, of the type that may be used for memorabilia or ornamental purposes such as a paperweight, bookened or the like. Although the making of replicas through the use of various mold processes has long been known, it is believed that the particular processes disclosed herein for making an ornamental replica of a child's hand are new.

U.S. Pat. No. 3,479,691 to Durland and U.S. Pat. No. 2,599,573 to Milton, Jr. are representative of previous patents granted for replica-making processes which utilize an elastic impression-forming material such as alginate. However, a method is not believed to be previously known in which an ornamental replica of a child's hand of the type disclosed herein can be quickly and inexpensively reproduced. Due to the simplicity and ease with which the present process will allow an ornamental replica of a child's hand to be manufactured, the present inventive method will lend itself to a mobile use, perhaps in chain store operations and the like. The inventive process is particularly adapted for this type of commercial embodiment in that it allows an accurate positive impression of the child's hand to be quickly and easily made at a mobile location with a minimum of material and then to be transported to a finishing location where the positive impression is provided with an ornamental and attractive finish by electroplating, soap finishing, painting or related coating techniques. The decorative replica may be used as a paperweight, bookend or the like. In so using the decorative replica the user will be continually reminded of the individual whose hand was utilized to manufacture the ornamental replica.

SUMMARY OF THE INVENTION

The present invention relates to a method of making an ornamental replica of a hand. In practicing the invention typically a child's hand would be utilized to make an ornamental replica according to the inventive method and thereby provide a decorative replica of the child's hand which may be used as a paperweight, bookend or the like having sentimental value to the owner. The hand of the child or adult, as the case may be, is placed onto a flat, smooth surface and a fluid, elastic impression-forming material is poured over the hand. After the impression-forming material has been applied over the hand, a temporarily pliable, solidifying support material is applied over the top surface of the impression-forming material and allowed to harden so as to form a rigid backing for maintaining the form of the impression material and the negative impression contained therein. Next, the hand is removed from the impression-forming material and the negative impression is filled with a pourable solidifying material to form a positive impression of the hand. The positive impression is withdrawn from the impression-forming material and an ornamental finish is applied so as to provide a decorative replica of the hand which may be used for a variety of ornamental end uses. The ornamental finish applied to the positive impression of the child's hand may be any suitable finish such as a "soap finish" or an electrolytically deposited layer of gold, silver, platinum, brass or the like which will create a pleasing effect to the eye.

Another embodiment of the present invention contemplates the use of a substantially rigid support tray into which the elastic impression material is placed. The support tray is then inverted over the top of the hand to be reproduced and urged downward toward the hand so as to force the elastic impression material over the top of the hand. This step could be substituted for the use of the temporarily pliable, solidifying support material which would normally be applied over the top surface of the impression-forming material after the impression-forming material had been applied over the hand.

From the foregoing, it will be apparent that this invention has as one of its principal objects the provision of a simple, economical process for making an ornamental replica of a human hand, particularly that of a young child.

Another object of the invention is to provide an efficient and economical method for making a replica of a child's hand which can be easily utilized by relatively low skilled personnel.

A further object of the invention is to provide a method for making a replica of a hand which utilizes a minimum amount of elastic, impression-forming material and provides a distortion free replica.

A more specific object of the invention is to provide a method for making a replica of a hand which will have a planar bottom surface rendering the replica particularly adapted for use as a paperweight, bookend, wall plaque or the like.

BRIEF DESCRIPTION OF THE DRAWINGS

FIG. 1 is a perspective view showing a child's hand;

FIG. 2 is a side elevation view of the hand placed upon a smooth, flat surface;

FIG. 3 is a side elevation showing the hand being coated by the elastic impression-forming material;

FIG. 4 is a side elevation of the hand after it has been coated with the impression-forming material and a temporarily pliable, solidifying support material has been applied over the top surface of the impression-forming material;

Figure 6:
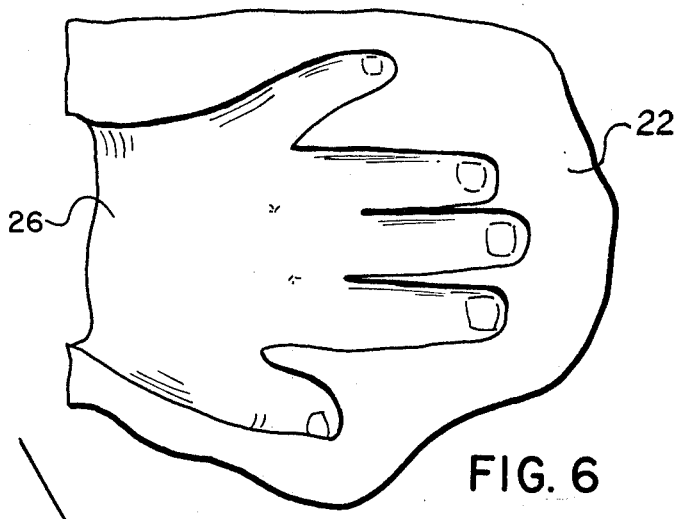
Figure 8:
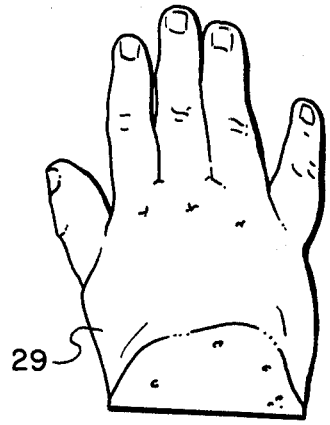
Figure 7:
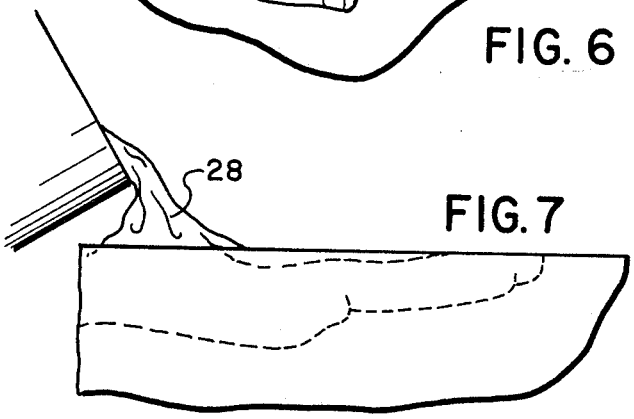
Figure 9:
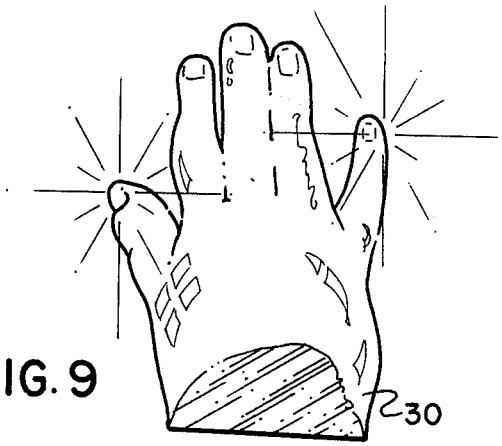
Figure 10:
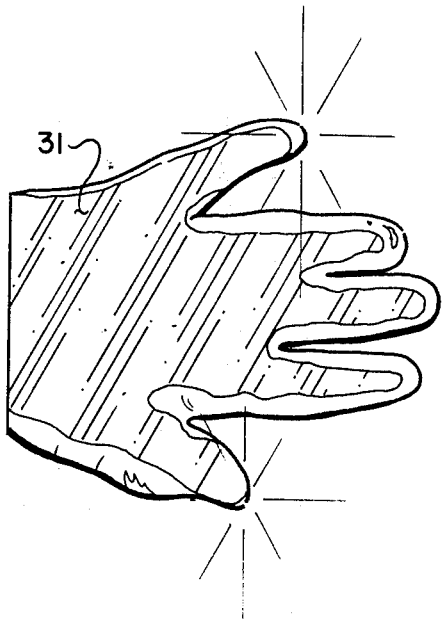
Figure 11:
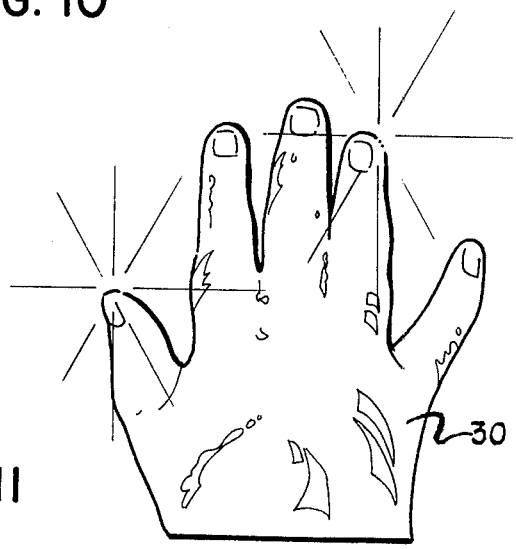

FIG. **4*a*** is an enlarged fragmentary view of the temporarily pliable, solidifying support material;

FIG. 5 is a sectional view of a second embodiment of the invention whereby a substantially rigid support tray containing the impression-forming material is inverted over the hand in order to create a mold of the hand and provide support to the impression-forming material;

FIG. 6 is a bottom plan view of the mold formed within the elastic impression-forming material after the hand has been removed therefrom;

FIG. 7 is a side elevation of the inverted mold being filled with a pourable, solidifying material;

FIG. 8 is a perspective view of the positive impression of the hand which has been removed from the elastic impression-forming material;

FIG. 9 is a perspective view of the positive impression of the hand after it has been decoratively coated;

Lo FIG. 10 is a bottom plan view of the decoratively coated positive impression of the child's hand; and FIG. 11 is a top plan view of the decoratively coated positive impression of the child's hand.

DESCRIPTION OF THE PREFERRED EMBODIMENT

Referring more specifically to the drawings, in FIG. 1 a child's hand 20 is shown. The hand 20 is placed onto a smooth, non-porous flat surface 21 as shown in FIG. 2 of the drawings. The smooth surface 21 may be of any suitable non-porous surface material such as glass, stainless steel or vinyl tile. After the hand has been placed onto the surface 21 a fluid, elastic impression-forming material 22 (FIG. 3) is applied over the surface of the hand 20. The elastic impression-forming material 22 may be one of several materials, however it is believed that an alginate, such as either sodium or potassium alginate would be most practical and economical to utilize in the practice of the present invention. Alternatively, a reversible hydrocollid or a rubber impression material such as polysulfide rubber or silicone rubber may be utilized. However, the alginate has inherent advantages over the hydrocollid and rubber impression material in that it is less messy, more economical, easier to manipulate with greater handling capabilities, and inherently has no odor or stain properties.

It is to be understood that alginate is a salt of alginic acid which is extracted from marine kelp and is a material in which gellation occurs by a chemical reaction. A typical trade name for alginate would be GELTRATE, SUPERGEL, KEY TO AL, AND UNIGEL II. Any of these particular trade name products and certain other alginates would perform well in the process described and claimed herein.

Normally the alginate in powder form is mixed with water so as to form a viscous fluid alginate material 22 which is applied over the entire surface of the hand 20. It is contemplated that the alginate 22 could be applied by pouring it over the hand 20 from a container or spraying it over the hand through the use of spray gun 23 (FIG. 3) adapted for applying a viscous fluid. At this stage of the process, one embodiment of the invention contemplates applying a heat deformable, solidifying support material 24 (FIG. 4*a*) to the top surface of the alginate (FIG. 4) and allowing the support material 24 to harden over the top surface of the alginate 22 to form a rigid backing. The support material 24 serves the purpose of forming a rigid support for the alginate 22 and thereby prevents distortion of the negative impression of the hand formed therein. Although the support material can be applied after the fluid alginate has gelled, it is preferable that the support material be applied prior to gelling so that it will be more thoroughly adhered to the alginate 22.

A typical trade name product which serves the purpose set forth above for a heat deformable solidifying support material is HEXCELITE, manufactured by the Hexcel Corporation. The material can be purchased in sheets or rolls and patches easily cut therefrom. Typically the HEXCELITE patch, a normally rigid polymeric material, is heated in nearly boiling water to a pliable and tacky state during which it is placed over the top surface of the alginate 22 (FIG. 4). Thereafter, the HEXCELITE support material air drys to a rigid state with a shape conforming to the contours of the alginate 22 within about 1–2 minutes. At that time any excess HEXCELITE may be trimmed from the alginate.

Alternatively, the alginate 22 may be placed into a support tray 25 prior to its application to the hand 20. Then the support tray 25 is inverted over the top of the hand 20 and forced downwardly (FIG. 5) so as to force the alginate 22 down over the hand 20. In so doing, the support tray 25 serves essentially the same function as the support material 24 in maintaining the alginate 22 in a fixed shape so as not to distort the negative impression formed therein by the hand 20. It is contemplated that the support tray 25 be fabricated from a disposable, substantially rigid material such as styrofoam or the like. It should be noted that use of the HEXCELITE material rather than support tray 25 may possibly minimize the amount of alginate required to make an impression of the hand and thereby be more economical.

The alginate will set or jell in about 1 minute after application. The hand 20 is then removed from the alginate 22 which will leave a negative impression 26 therein, as best seen in FIG. 6. The negative impression is filled with a pourable hardening composition 28 (FIG. 7) so as to form a positive impression of the hand 20. The pourable solidifying material 28 is most suitably plaster-of Paris. Although a plaster-of-Paris hardening material (preferably a quick-hardening type requiring about five minutes in which to set) is the most economical and easy to use in the instant process, other materials such as plastic, resins, nylon or styrofoam can be used. If a non-quick set plaster-of-Paris is utilized, about 15 minutes is required for the plaster to harden within the alginate 22.

At this point, the positive impression plaster hand 29 is withdrawn from the alginate 22. The positive impression plaster hand 29 (FIG. 8) is an accurate and directly proportional replica of the original hand 20.

For ornamental and decorative purposes, it is desirable to coat the positive impression with a decorative coating. This decorative coating may take several forms including a "soap coating" comprising immersing the positive impression plaster hand 29 in a liquid soap for about 10 minutes, allowing the soap to penetrate the micro-pores of the plaster-of-Paris. After the soap solution has dried, the positive impression plaster hand 29 is polished with a cotton cloth or sponge leaving a smooth and shiny surface. Any liquid soap such as the trade name soap LIQUID IVORY SOAP can be utilized for this step of the process.

The positive impression plaster hand 29 may also be electroplated. In order to electroplate the positive impression plaster hand 29 with a plating such as gold, silver, platinum or brass, positive impression 29 is first coated with an electro-conductive film such as a shellac with metal particles dispersed therein. Next, the ornamental layer of the plating is electrolytically deposited on the positive impression plaster hand 29. The result is a striking replica of the subject child's hand which gives the appearance to the observer of being formed of a solid piece of gold, silver, platinum, brass or any other material which is plated threon.

FIG. 9 best shows a perspective view of the finished ornamental replica 30 manufactured by the process of the present invention. It should be further noted, as best seen in FIG. 10, that the process of the present invention produces an ornamental replica 30 which has a substantially flat bottom surface 31. This, of course, is due to the fact that the alginate mold material 22 is essentially applied only to the upper surface area of the hand and therefore creates a negative impression 26 which will, when filled with plaster-of-Paris 28, create a positive impression 29 with flat bottom surface 31. The top and sides of the hand, as best seen in FIG. 11, are an exact proportional reproduction of the subject child's hand whereas the flat bottom surface 31 noted hereinbefore facilitates the use of the finished replica 30 as a paperweight, bookend, wall plaque or other related type of end use.

Thus, the present invention provides a simple and economical method of making an ornamental replica of a hand which is particularly adapted for any suitable memorabilia purpose such as a paperweight or bookend. The invention further contemplates that the components disclosed herein which are necessary to practice the method of the invention can be provided in a kit form so as to allow the user to make the replicas at a time and place convenient to the user.

In the drawings and specification, there has been set forth a preferred embodiment of the invention and, although specific terms are employed, they are used in a generic and descriptive sense only and not for purposes of limitation, the scope of the invention being defined in the claims.

I claim:

1. A method of making an ornamental replica of a hand comprising:

placing the hand to be reproduced onto a relatively flat surface;

applying a fluid, elastic impression-forming material over the hand;

allowing the impression-forming material to dry and create a mold-like elastic form over the hand thereby creating a negative impression of the hand therein;

applying a temporarily pliable, solidifying thermoplastic support material over the top surface of the impression-forming material prior to or upon drying thereof and allowing said support material to harden so as to form a rigid backing to maintain the form of the impression-material and the negative impression contained therein;

removing the hand from the impression-forming material and filling the negative impression with a pourable solidifying material to form a positive impression of the hand;

withdrawing the positive impression from the impression-forming material and coating the positive impression with an electricity-conducting film; and electrolytically depositing an ornamental layer of gold, silver, brass or the like on the positive impression of the hand to provide a decorative replica.

2. The method of claim 1 where said impression-forming material comprises an alginate, preferably a sodium or potassium alginate.

3. The method of claim 1 where said temporarily pliable, solidifying support material comprises a patch of a polymeric material which is capable of being heated in near-boiling water to a temporarily pliable and tacky state.

4. The method of claim 1 where said pourable solidifying material comprises a mixture of plaster-of-Paris and water.

5. A method of making an ornamental replica of a hand comprising:

placing the hand to be reproduced onto a substantially smooth, flat surface;

applying an impression-forming alginate in substantially fluid form over the hand;

allowing the alginate to substantially jell into a mold-like form over the hand creating a negative impression of the hand therein;

applying a patch of heated heat-deformable solidifying support material to the top surface of the alginate prior to or upon jelling thereof and allowing the support material to harden so as to form a rigid backing to prevent distortion of the negative impression in the alginate;

removing the hand from the alginate and filling the negative impression with a fluid plaster-of-Paris composition capable of quick drying so as to form a positive impression of the hand;

withdrawing the positive impression from the alginate and coating the impression with an electricity-conducting film; and electrolytically depositing an ornamental layer of gold, silver, brass, platinum or the like on the positive impression of the hand to provide a decorative replica.

6. A method of making an ornamental replica of a hand comprising:

placing the hand to be reproduced onto a surface area;

applying an elastic, gelatinuous impression-forming material over the hand;

allowing the impression-forming material time to form a mold over the hand thereby creating a negative impression of the hand therein;

applying a temporarily pliable solidifying thermoplastic support material to the top of the elastic, gelatinous impression-forming material to form a rigid support for the impression-forming material to prevent distortion of the negative impression therein;

removing the hand from the impression-forming material and filling the negative impression with a fluid material capable of hardening to form a positive impression of the hand;

withdrawing the positive impression from the impression-forming material.

7. The method of claim 6 where the fluid material capable of hardening comprises a mixture of plaster-of-Paris and water.

8. The method of claim 7 where the step of applying an ornamental finish to the positive impression comprises immersing the positive impression in a soap and water solution so that the soap will penetrate the micropores of the plaster-of-Paris and fill the same, and rubbing the positive impression with a suitable material such as cotton, cloth or a sponge so as to give the positive impression a shiny and smooth finish.

9. The method of claim 6 where the step of applying an ornamental finish to the positive impression comprises electrolytically depositing an ornamental layer of gold, silver, brass, platinum or the like on the positive impression.

10. The method of claim 6 where said impression-forming material comprises an alginate, preferably a sodium or potassium alginate.

11. The method of claim 6 where said support material comprises a patch of a normally rigid polymeric material which has been heated in near boiling water to a temporarily pliable and tacky state.

* * * * *